US008122656B1

(12) United States Patent
Poulsen

(10) Patent No.: US 8,122,656 B1
(45) Date of Patent: Feb. 28, 2012

(54) FIRE SUPPRESSION SURFACE SYSTEM

(76) Inventor: Peter D. Poulsen, Grants Pass, OR (US)

( * ) Notice: Subject to any disclaimer, the term of this patent is extended or adjusted under 35 U.S.C. 154(b) by 2204 days.

(21) Appl. No.: 10/944,620

(22) Filed: Sep. 17, 2004

Related U.S. Application Data

(60) Provisional application No. 60/504,350, filed on Sep. 18, 2003.

(51) Int. Cl.
*E04C 2/00* (2006.01)

(52) U.S. Cl. ..... 52/232; 52/506.01; 52/783.11

(58) Field of Classification Search ..... 404/36, 404/43; 169/46, 62, 66, 67, 45, 49; 206/461, 206/416, 803; 428/73; 52/232, 834, 506.01, 52/506.02, 790.1, 793.1, 794.1, 783.17, 783.18, 52/783.11
See application file for complete search history.

(56) References Cited

U.S. PATENT DOCUMENTS 3,182,727 A * 5/1965 Minton ..... 169/49
3,380,206 A * 4/1968 Barnett ..... 52/145
4,251,579 A * 2/1981 Lee et al. ..... 428/73
5,044,821 A * 9/1991 Johnsen ..... 405/50
5,585,047 A * 12/1996 Mortensen et al. ..... 261/109
5,820,296 A * 10/1998 Goughnour ..... 405/43
5,894,045 A * 4/1999 Desrondiers ..... 428/178
2002/0139068 A1* 10/2002 Janesky ..... 52/169.5
2004/0050723 A1* 3/2004 Wilke et al. ..... 206/216
* cited by examiner

*Primary Examiner* — Eileen D Lillis
*Assistant Examiner* — Jessica Laux
(74) *Attorney, Agent, or Firm* — David S. Alavi

(57) ABSTRACT

A fire suppression surface system comprises a flat sheet and a plurality of support members. The sheet has fluid channels therethrough. The support members lie on a support surface in a spaced-apart arrangement, and the sheet rests on the support members substantially parallel to and offset vertically above the support surface and defines with the support surface a containment space for receiving fluid spilled on the upper surface of the sheet that flows through the fluid channels. Area of channel upper openings is larger than about twice area of lower openings so as to restrict flow of air into or restrict escape of combustion products from the containment space, thereby suppressing combustion of a flammable fluid spilled on the sheet. A method for suppressing combustion of flammable fluid spilled on the support surface comprises covering the support surface with the sheet supported by the support members.

77 Claims, 7 Drawing Sheets

FIG. 4A
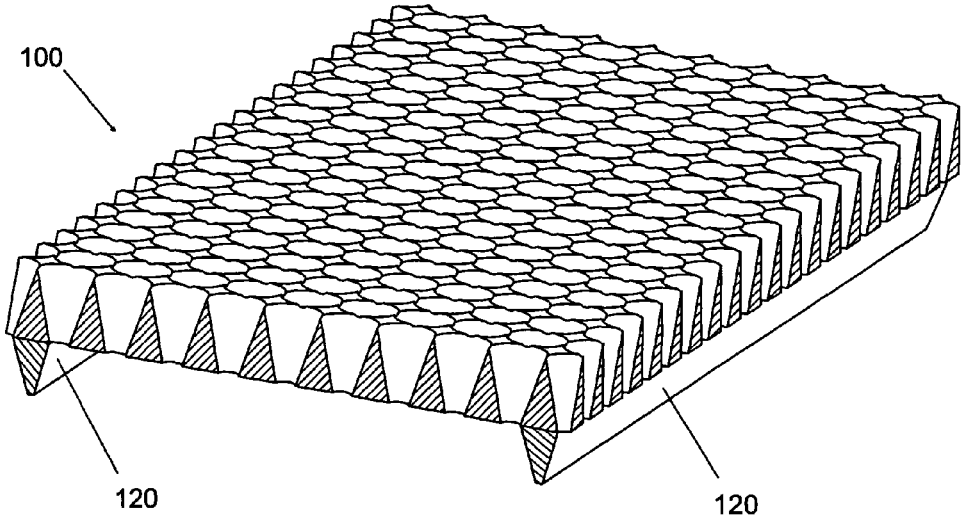
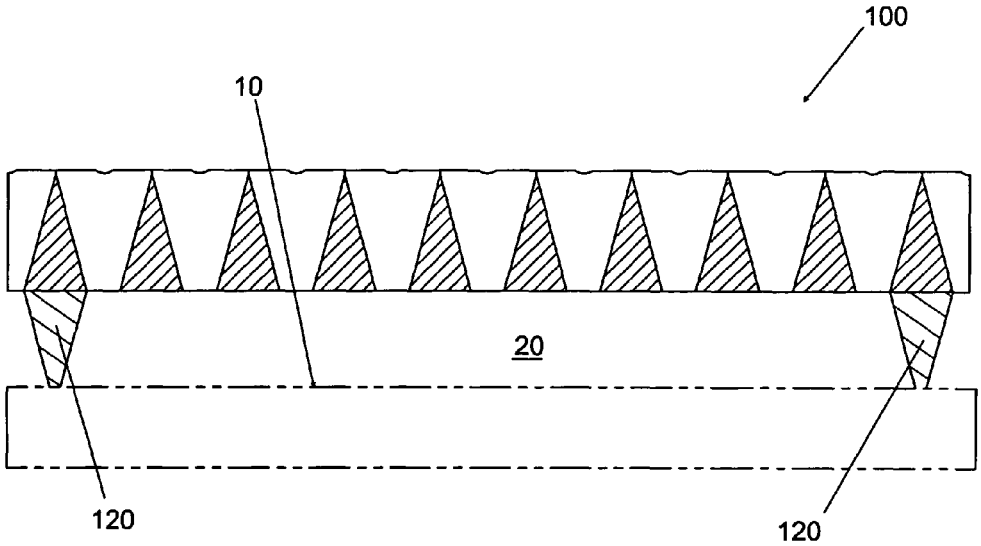
FIG. 4B

FIRE SUPPRESSION SURFACE SYSTEM

RELATED APPLICATIONS

This application claims benefit of prior-filed provisional App. No. 60/504,350 entitled "Fire suppression surface system" filed Sep. 18, 2003 in the name of Peter D. Poulsen, said provisional application being hereby incorporated by reference as if fully set forth herein.

BACKGROUND

The field of the present invention relates to fire suppression. In particular, apparatus and methods are described herein for passive suppression of combustion of flammable liquids on surfaces.

Surfaces where fluid spills can occur and where ignition and combustion of the fluids are particularly dangerous must have fire suppression systems in place. Examples may include, but are not limited to: an aircraft carrier flight deck or hangar deck; a helipad; the floor of an engine compartment; the ground near a refueling facility; the floor of a vehicle repair facility; the floor of a fuel, solvent, or chemical storage area; the floor of a fuel, solvent, or chemical processing facility; the ground near a fuel, solvent, or chemical loading or unloading zone or shipping terminal; the floor of a semiconductor processing facility; the ground of a racetrack pit area; an oil drilling platform; an aircraft hangar; or the floor of a mill or manufacturing facility. Even without the violence of an aircraft or vehicle crash, leaked or spilled fuel on a surface is a fire threat. In the case of a crash or accident, structural damage may be minor but there may nevertheless be a great risk of fire due to potential ignition of fuel spilled from fuel tanks. Burning fuel flows onto the ground, a floor, a deck, or other surface and spreads rapidly to surrounding areas. Any fire that is not suppressed or extinguished immediately may kill or injure vehicle occupants, firefighters, other rescue or emergency personnel, or bystanders. A fire may also result in damage to the spill surface or structure that supports, houses, or otherwise attends the spill surface. For these and other reasons, it is desirable to provide fire suppression for such surfaces where spills of flammable fluids may occur.

SUMMARY

A passive fire suppression surface system comprises a substantially flat sheet and a plurality of support members. The sheet has a plurality of fluid channels therethrough, with each fluid channel having an upper opening at an upper surface of the sheet and a corresponding lower opening at a lower surface of the sheet. Fluid spilled on the upper surface of the sheet may flow therethrough by flowing through at least one of the fluid channels. The support members lie on a support surface in a spaced-apart arrangement, and the sheet rests on the support members and is thereby positioned substantially parallel to and offset vertically above the support surface. The support surface and the sheet thereby define a containment space for receiving fluid spilled on the upper surface of the sheet that flows through the fluid channels of the sheet. The area of each upper opening is larger than about twice the area of each corresponding lower opening so as to restrict flow of air into the containment space or restrict escape of combustion products from the containment space, thereby suppressing combustion of a flammable fluid spilled on the upper surface of the sheet. A method for passively suppressing combustion of flammable fluid spilled on the support surface comprises covering at least a portion of the support surface with the sheet supported by the support members.

Objects and advantages pertaining to passive fire suppression on surfaces may become apparent upon referring to the disclosed embodiments as illustrated in the drawings and disclosed in the following written description or claims.

BRIEF DESCRIPTION OF THE DRAWINGS

FIG. 4 is a top perspective view of a fire suppression surface system.

Figure 1A:
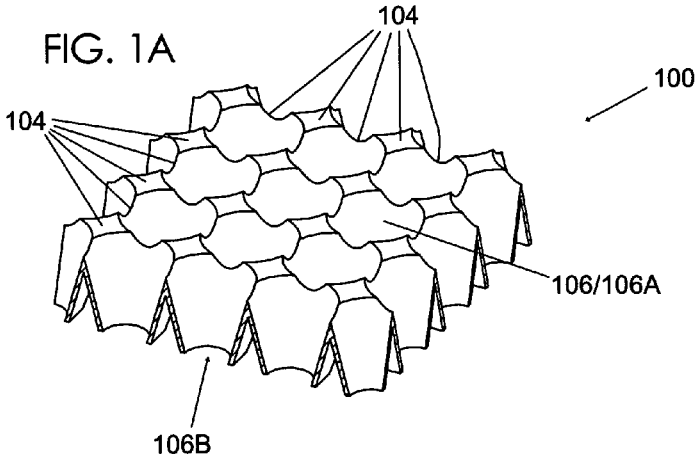
FIGS. 1A-1D are top perspective and cross-sectional views of a sheet of a fire suppression surface system.

The embodiments shown in the Figures are exemplary, and should not be construed as limiting the scope of the present disclosure or appended claims.

DETAILED DESCRIPTION OF EMBODIMENTS

FIGS. 1A-1D, 2A-2B, 3A-3B, 4, 5A-5B, 6A-6B, and 7 illustrate exemplary embodiments of a passive fire suppression surface system. A substantially flat sheet 100 has a plurality of fluid channels 106 therethrough. Each channel 106 has an upper opening 106A at the upper surface of the sheet 100, and a lower opening 106B at the lower surface of the sheet 100. Fluid spilled on the upper surface of the sheet may flow through the sheet 100 through at least one, and typically many, of the fluid channels 106. The sheet 100 rests on a plurality of support members 120 that in turn lie on a support surface 10 in a spaced-apart arrangement. The support members 120 position the sheet 100 substantially parallel to and offset vertically above the support surface 10. The sheet 100 and the surface 10 therefore define a containment space 20 therebetween (FIGS. 4B, 5A-5B, and 6A-6B), for receiving fluid spilled on the upper surface of the sheet 100 that flows through the fluid channels 106. The area of each upper opening 106A is larger than about twice the area of a corresponding lower opening 106B, and may be larger than about 4 to 10 times the area of the corresponding lower opening 106B. This difference in area restricts flow of air into the containment space or restricts escape of combustion products from the containment space. Either or both of these may suppress combustion of flammable liquid spilled on the upper surface of the sheet, whether already burning when spilled or ignited after being spilled (such fire suppression might be characterized as suffocation). The sheet 100 may comprise any sufficiently rigid, sufficiently non-flammable material, including but not limited to metallic material, ceramic material, or polymer material. Stainless steel and titanium are examples of metallic materials that may be employed for forming sheet 100. The sheet may be formed in an suitable way, including but not limited to molding, casting, stamping, extrusion, or milling.

Figure 1B:
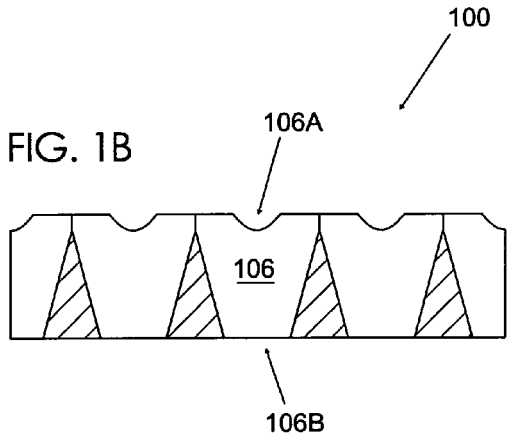
Figure 1C:
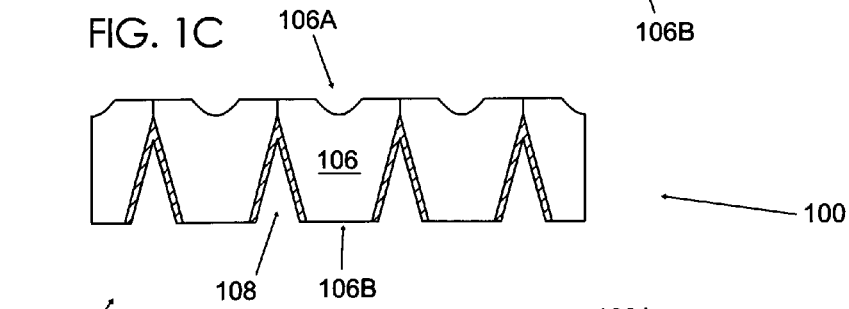
Figure 1D:
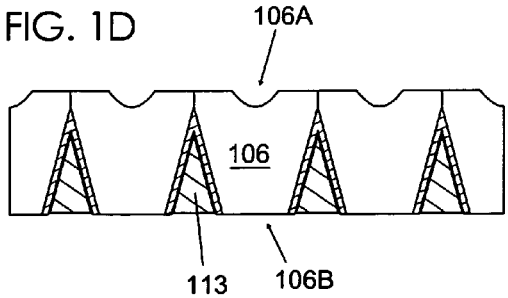
Figure 2A:
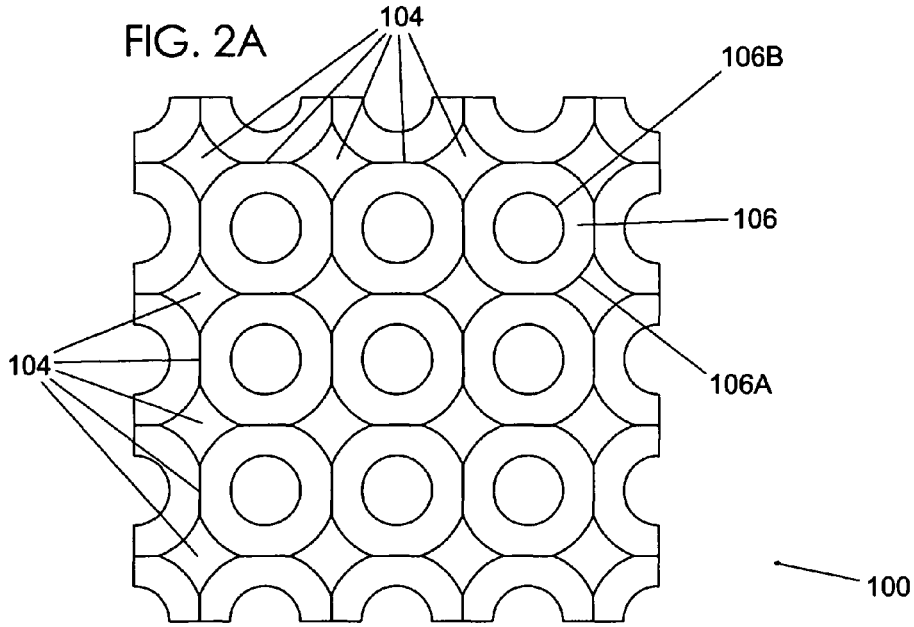
FIGS. 2A and 2B are top and bottom views, respectively, of a sheet of a fire suppression surface system.
Figure 2B:
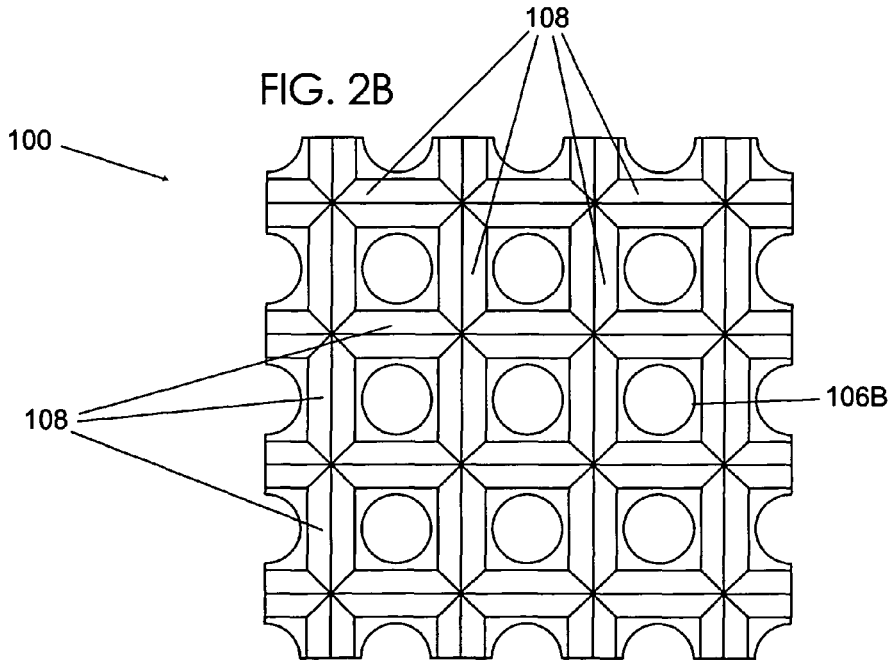
Figure 3A:
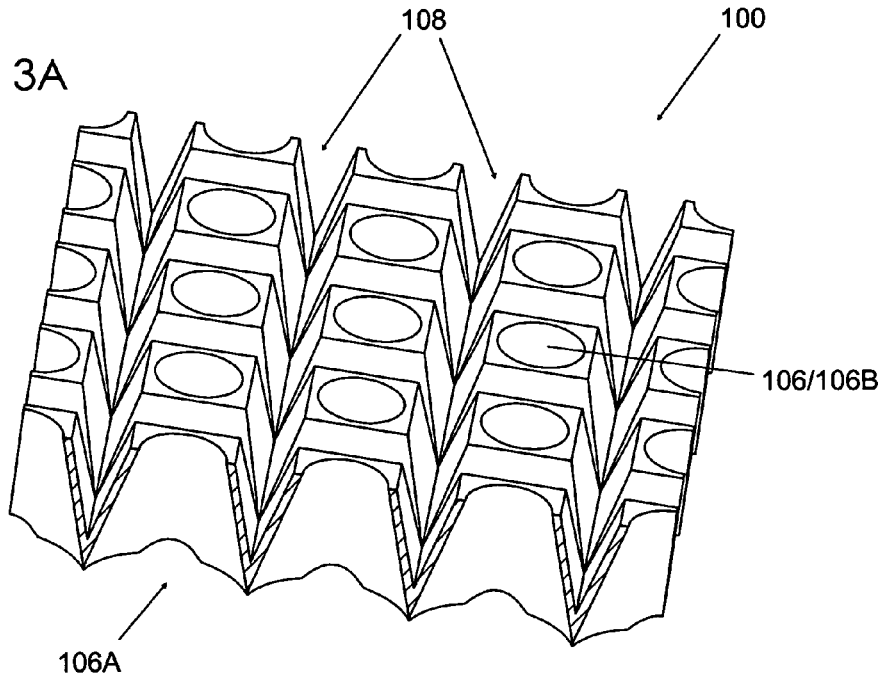
FIGS. 3A and 3B are bottom perspective views of a sheet of a fire suppression surface system.
Figure 3B:
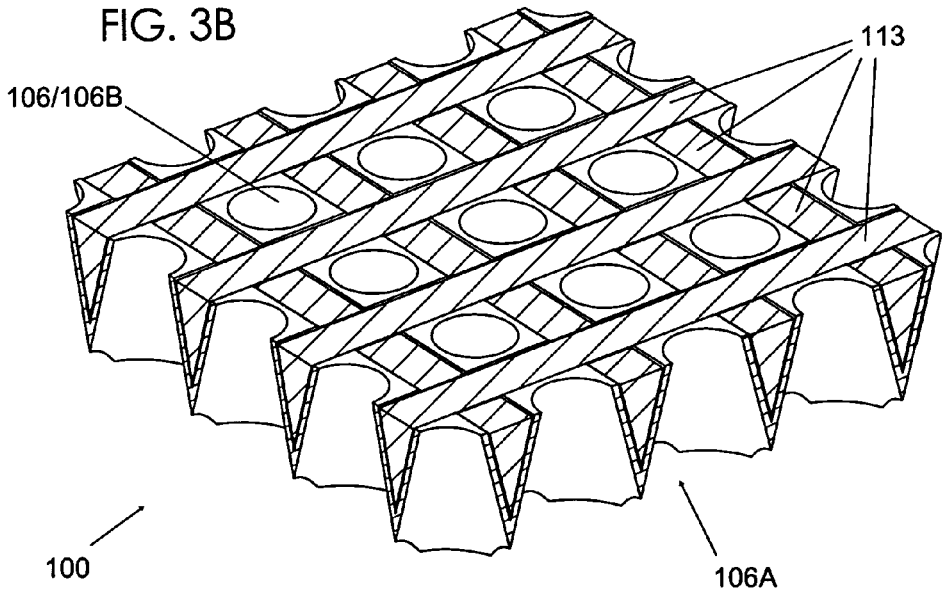
Figure 5A:
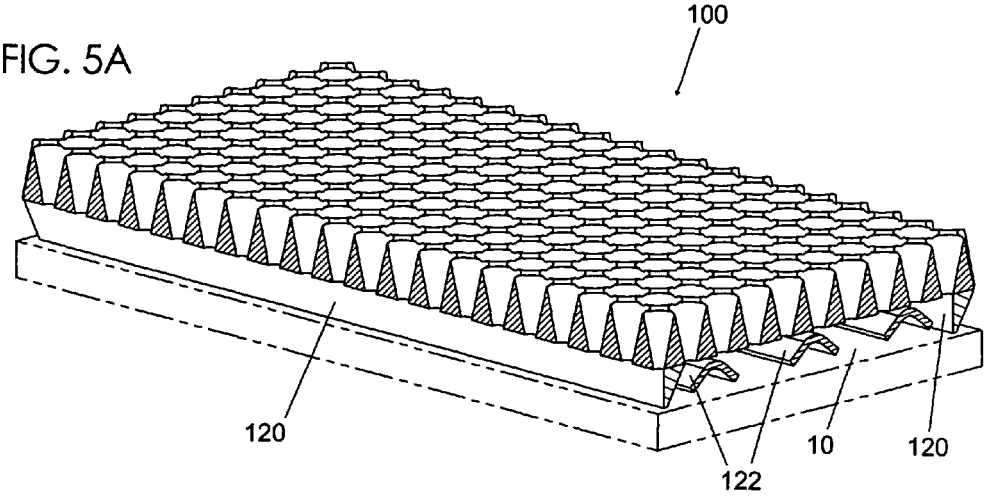
FIGS. 5A and 5B are top perspective and cross-sectional views, respectively, of a fire suppression surface system.
Figure 5B:
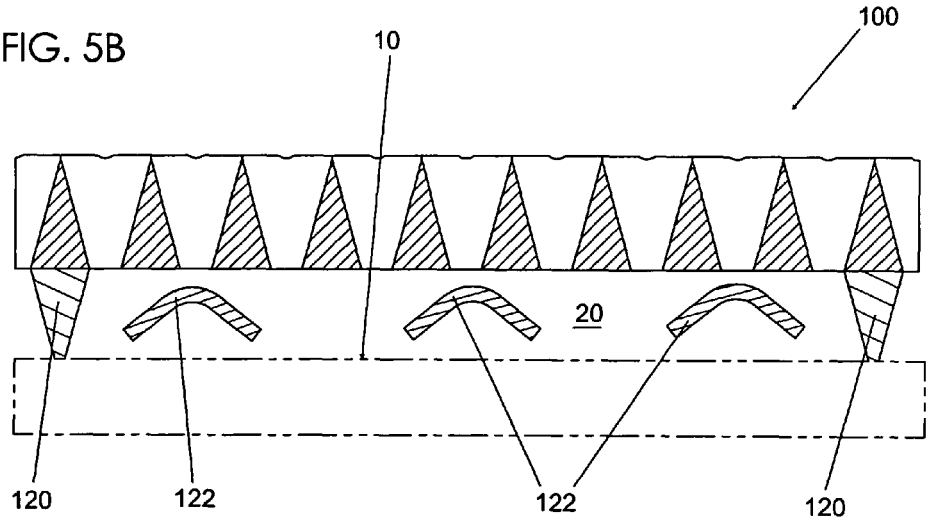
Figure 6A:
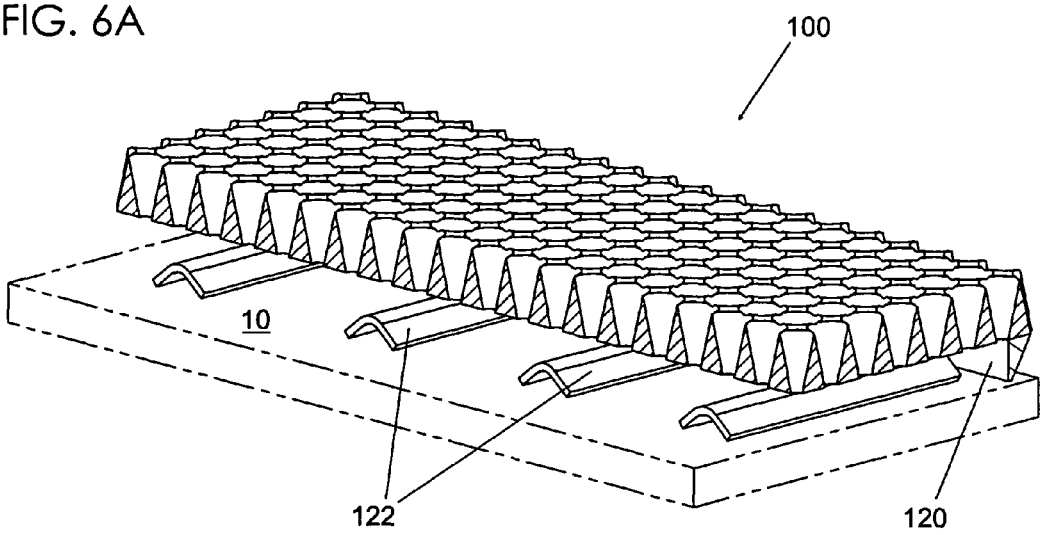
FIGS. 6A and 6B are top perspective and cross-sectional views, respectively, of a fire suppression surface system.
Figure 6B:
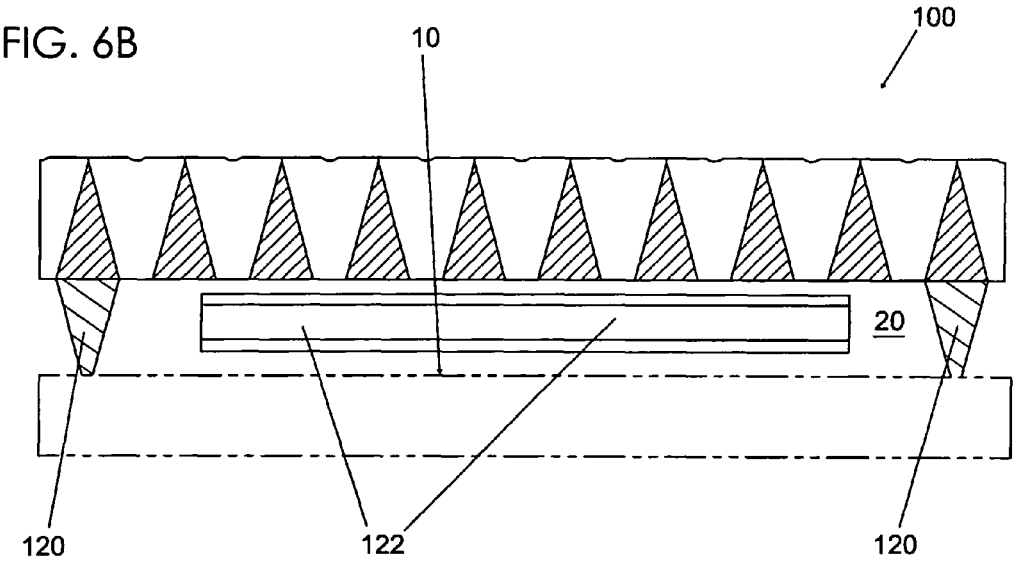

The fluid channels 106 may be formed so that the cross-sectional area of each fluid channel 106 decreases substantially monotonically from the upper opening 106A to the lower opening 106B. The exemplary embodiment shown in the Figures has frusto-conical fluid channels (FIGS. 1B-1C and 2A). Channels in the shape of inverted, truncated square or rectangular pyramids could be employed. Any channel shape suitable for enabling adequate flow of spilled fluid and with sufficiently differing areas of the upper and lower openings shall fall within the scope of the present disclosure or appended claims. The channels may be arranged on sheet 100 in any suitable way. It may be convenient to arrange the fluid channels 106 in a two-dimensional lattice pattern (square, rectangular, trigonal, hexagonal, or some other regular pattern; a square lattice pattern is shown in the Figures). Exemplary dimensions for fluid channels may be: lower opening area less than about 10 $mm^2$, or about 4-6 $mm^2$; sheet thickness between about 3 mm and about 10 mm, or about 5-7 mm; fluid channels arranged on a lattice pattern with a spacing between about 3 mm and about 10 mm, or about 5-7 mm. Other dimensions or arrangements, including dimensions outside these ranges, may nevertheless fall within the scope of the present disclosure or appended claims.

Arrangement of fluid channels 106 on a two-dimensional lattice pattern sufficiently close together results in an upper surface of sheet 100 comprising a plurality of elongated ridges 104 (FIGS. 1A and 2A; the ridges in these examples comprise alternating saddle segments and flat segments). The two-dimensional lattice pattern results in these ridges 104 extending along the sheet in at least two directions to form a grid. The ridges 104 may be made sufficiently narrow (by sufficiently close spacing of the fluid channels 106) so as to substantially eliminate accumulation of fluid on the upper surface of the sheet. For example, the flat segments of the ridges in the exemplary embodiments of FIGS. 1A and 2A become smaller with decreasing spacing of the fluid channels. Alternatively, any flat segments of the ridges 104 may be tilted, rounded, or otherwise adapted for eliminating fluid accumulation thereon. The grid also provides a non-slip or non-skid surface for foot traffic or vehicles. The arrangement of the fluid channels 106 or ridges 104 may be altered in any suitable way so as to achieve desired non-slip, non-skid, or other frictional properties for the upper surface of the sheet 100. Such alterations or adaptations shall fall within the scope of the present disclosure or appended claims.

The plurality of support members 120 may comprise elongated support members lying on the support surface in a spaced-apart, side-by-side arrangement. The support members 120 position the sheet 100 substantially parallel to and offset vertically above the support surface 10. The sheet 100 and the surface 10 therefore define a containment space 20 therebetween for receiving fluid spilled on the upper surface of the sheet 100 that flows through the fluid channels 106. The elongated support members 120 may be secured to or formed on the lower surface of the sheet 100. In this case deployment or installation of the fire suppression surface system comprises covering the desired area of the support surface 10 with sheet 100, with support members 120 already on sheet 100. Alternatively, the sheet 100 and support members 120 may comprise mechanically separate components. If comprising separate components, deployment or installation of the fire suppression surface system comprises first placing support members 120 on the desired area of support surface 10, and then covering the desired area with sheet 100. The support members 120 may be secured to or formed on the support surface 10. Regardless of the method used therefor, after deployment or installation the sheet 100 rests on the support members 120, which in turn lie on support surface 10 (FIGS. 4B, 5A-5B, and 6A-6B).

The support members may comprise any material or material combination sufficiently rigid for supporting sheet 100 and any loads thereon (vehicles, personnel, equipment, and so forth). The support members may be configured to support the sheet 100 at a height between about 3 mm and about 10 mm, or about 5-7 mm, above the support surface 10. Other heights may be employed and may fall with the scope of the present disclosure or appended claims. The elongated support members 120 may be spaced-apart laterally by about 20-100 mm, or about 40-70 mm. Any spacing that provides sufficient support for the sheet 100 and any load thereon may be employed, and shall fall within the scope of the present disclosure or appended claims. Depending on the area to be covered, the sheet 100 may be provided as a single sheet, or in multiple pieces that are tiled together to cover the desired area of support surface 10 regardless of its size.

In some circumstances it may be desirable to support sheet 100 from above, rather than from below. In other words, the sheet 100 may be suspended by support members to hang above the surface 10. Such suspension of sheet 100 above surface 10 shall fall within the scope of the present disclosure or appended claims.

It may be desirable to impede flow of air or fluid within the containment volume. Spaced-apart, side-by-side elongated support members 120 may serve to impede flow in one dimension. Baffle members 122 may be positioned between the support members 120 so as to further impede flow of air or spilled fluid within the containment space 20 (FIGS. 5A-5B and 6A-6B). Elongated baffle members 122 may be oriented approximately transversely to the elongated support members (FIGS. 6A-6B), so as to impede flow of air or spilled fluid parallel to the support members 120. Such impeded flow may reduce the amount of air that may reach burning fluid in the containment space from edges of the sheet 100, or may reduce the amount of fluid upwelling through the fluid channels 106 if the support surface 10 is tilted (as might be the case on the deck of a ship). Space is left between baffle members 122 and support members 120 to allow some restricted flow of air or fluid, so that air trapped in the containment space does not impede flow of spilled fluid through the fluid channels 106, or to allow spilled fluid to be recovered from the containment space by flow to an edge of the sheet 100. The baffle members 122 may be secured to or formed on the lower surface of sheet 100, or may be provided as mechanically separate components. If provided as separate components, baffle members 122 may be secured to or formed on the support surface 10. Description of methods of deployment or installation of the fire suppression surface system with baffle members 122 is similar to the description of such methods pertaining to the support members 120, as set forth hereinabove.

The lower surface of sheet 100 may be substantially flat except for the lower opening 106B of the fluid channels 106. Sheet 100 would therefore comprise a slab with fluid channels 106 therethrough (FIG. 1B). Alternatively, the lower surface of the sheet 100 may include recessed regions 108 between the fluid channels 106 (FIGS. 1C, 1D, 2A, and 3A-3B). These recessed regions 108 may form a grid roughly corresponding to the grid of ridges 104 on the upper surface of sheet 100. Such recessed regions 108 may serve to reduce the weight of sheet 100. Such recessed areas also increase the surface area of the lower surface of sheet 100, which may provide enhanced convective cooling of sheet 100. This may be advantageous when the sheet 100 is deployed outdoors and may be subject to a significant solar load, for example, and heating of the sheet under a solar load my increase the risk of ignition of flammable fluids. The increased surface area of the lower surface of sheet 100 may also increase the rate at which heat may be dissipated during a fire by conduction or convection.

Fire retardant or fire suppressant material 113 may be applied to the lower surface of sheet 100. Suitable materials may include, but are not limited to:

a) Binary agents. For example, separately encapsulated acid and carbonate or bicarbonate salts would release carbon dioxide upon mixing, which would tend to smother a fire. The encapsulation means (an organic polymer coating, for example) might be soluble in the flammable liquid, or melted or decomposed by the heat of the fire.

b) Decomposing agents. Carbonate or bicarbonate salts may decompose at elevated temperatures (as in a fire) and release carbon dioxide, which would tend to smother the fire. Hydrated salts may release their water of hydration at elevated temperatures, which may serve to smother the fire or may serve to carry away heat of vaporization and cool the fire.

c) De-volatilizing agents. Organic or polymeric coatings (such as shellacs) may absorb volatile flammable fluids, thereby lowering the vapor pressure and suppressing the fire. Similarly, gelling or polymerizing agents may also serve to reduce vapor pressure of volatile flammable liquids, although they may make subsequent cleanup of the spilled liquid more difficult.

These, or any other suitable heat- or fluid-activated fire retardant or fire suppressant material may be employed, and shall fall within the scope of the present disclosure or appended claims. Suitable fire retardant or fire suppressant materials may be activated by contact with spilled fluid, by the heat of combustion, or both. The fire retardant or fire suppressant material may be applied to a substantially flat lower surface of sheet 100. The presence of recessed regions 108 on the lower surface of sheet 100 results in an increased surface area where fire retardant or fire suppressant material may be applied, or still more fire retardant or fire suppressant material may be applied by completely or partially filling the recessed regions therewith (as in FIGS. 1D and 3B). Since the fire retardant or fire suppressant material is applied to the lower surface of the sheet 100, it is not subject to wear or accidental removal by foot or vehicular traffic or other environmental influences.

The fire suppression surface system may be deployed or installed in a variety of environments wherein flammable fluids are in use. Examples of surfaces where the system may be deployed or installed may include but are not limited to: an aircraft carrier flight deck or hangar deck; other warships; an oil tanker or other fuel-carrying vessel; freighters; other ships or vessels; a helipad; the floor of an engine compartment; the ground near a refueling facility; the floor of a vehicle repair facility; the floor of a fuel, solvent, or chemical storage area; the floor of a fuel, solvent, or chemical processing facility; the ground near a fuel, solvent, or chemical loading or unloading zone or shipping terminal; the floor of a semiconductor processing facility; the ground of a racetrack pit area; an oil drilling platform; an aircraft hangar; or the floor of a mill or manufacturing facility.

Figure 7:
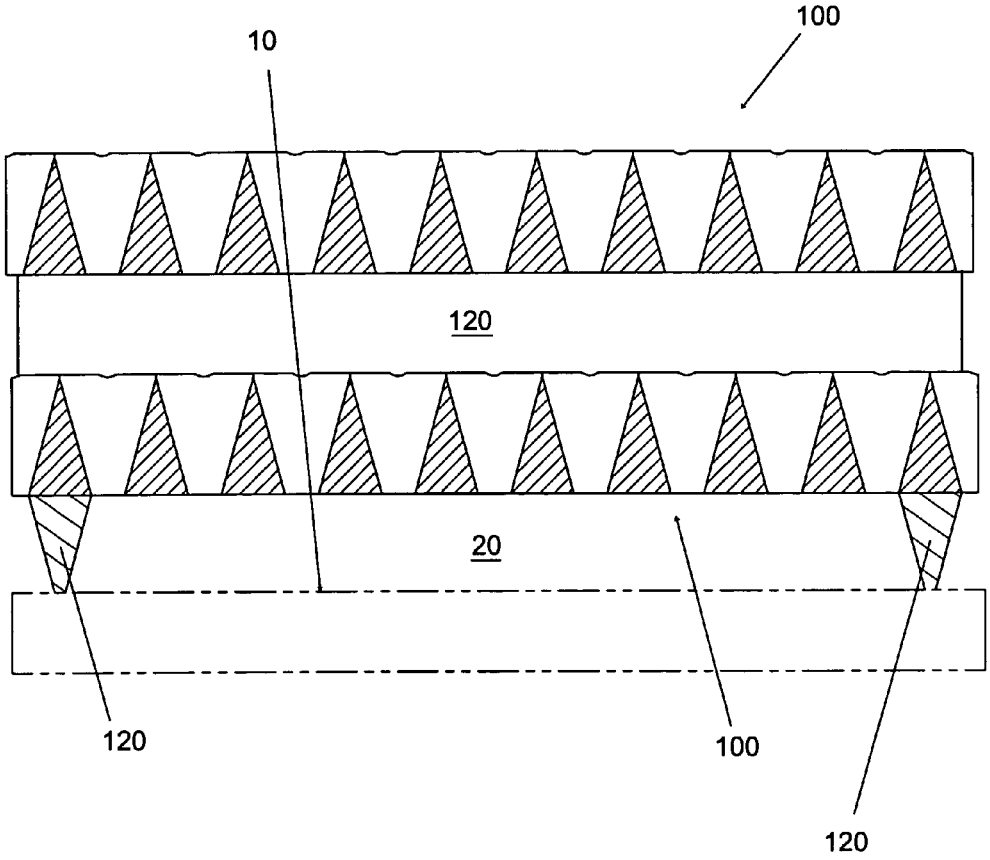
FIG. 7 is a cross-sectional view of a fire suppression surface system.

The effectiveness of the fire suppression surface system may be enhanced by stacking two sheets 100 over the support surface 10 (FIG. 7). The first (lower) sheet 100 rests on its corresponding support members 120 on the support surface 10. The second sheet 100 rests on its corresponding support members 120 on the lower sheet. If the supports members 120 are elongated, it may be desirable to orient them in differing directions, perhaps substantially perpendicular to one another, for structural strength or stability. If two or more sheets are stacked, the fluid channels of all but the uppermost sheet may be larger and more widely spaced, since their upper surfaces are not in direct contact with personnel, vehicles, or equipment.

Fluid channels 106 having frusto-conical, truncated pyramidal, or similar shapes may also serve to preferentially direct heat radiated from below the sheet 100. If the surfaces of sheet 100 are sufficiently reflective (i.e., have sufficiently low emissivity) at the relevant wavelengths, then a portion of heat radiated from below the sheet will be directed preferentially in a direction substantially perpendicular to the sheet 100 (by direct radiation through lower openings 106B, with or without reflecting from the inner surface of fluid channels 106). For example, calculations for closely-spaced frusto-conical fluid channels having an upper opening diameter about 2.5 times the lower opening diameter, and a length about 5 times the lower opening diameter, yield a radiated heat angular distribution having over 95% of the radiated heat emitted in directions more than 50° above horizontal. Such preferential upwardly-directed radiation of heat may allow firefighters or other emergency personnel to approach the fire more closely without being burned by heat radiating from the surface. Other shapes or arrangements of the fluid channels to achieve desired radiant heat angular distributions may be designed and implemented, and shall fall within the scope of the present disclosure or appended claims.

The emissivity of sheet 100 determines in part the effectiveness of the preferential direction of heat radiated from below the sheet. For relatively low emissivity (below about 70%), preferential upwardly-directed radiation of heat from below sheet 100, as described hereinabove, is observed. For relatively high emissivity (above about 70%), preferential upwardly-directed radiation is diminished or absent. For a sheet with sufficiently low emissivity, a substantial portion of radiation incident on the sheet from below is reflected back toward the support surface 10 and may be reradiated therefrom, while a substantial portion of radiation passing through a lower opening 106B and incident on the inner surface of a fluid channel 106 is reflected and redirected in a more upward direction. These result in preferential upwardly-directed radiation. For a sheet 100 with high emissivity (i.e., high absorptivity), however, a substantial portion of radiant heat incident on sheet 100 (from below or on the inner surfaces of fluid channels 106) is absorbed by sheet 100 and reradiated in a substantially isotropic fashion. Transition between these two exhibited behaviors has been observed to occur over a range of emissivity around 70%, although this limit may depend on the details of the dimensions and geometry of the sheet 100 and fluid channels 106.

It may be desirable to employ a sheet 100 on any hot surface for preferential redirection of heat radiated therefrom, even in the absence of the possibility of flammable liquid spills or ignition. A sheet 100 with support members 120 may be positioned on a surface of any orientation when preferential redirection of heat radiated therefrom may be desired. Depending on the orientation of the covered surface, the support members 120 may or may not support the weight of the sheet 100, and securing of support members to the sheet 100 or the covered surface may or may not be required. However, support members 120 still serve to provide space between the covered surface and sheet 100 so as to reduce or substantially eliminate direct conduction of heat therebetween (which would serve to diminish the preferentially directed radiation of heat). Many examples of hot surfaces may be imagined where such preferential direction of radiated heat may be desirable (such as outer surfaces of ovens, kilns, or furnaces, for example), and use of sheet 100 and support member 120 for thus preferentially directing radiated heat from any desired surface shall fall within the scope of the present disclosure or appended claims.

If the sheet 100 comprises metallic material, fluid channels 106 may be sized and arranged to yield desired electromagnetic properties. For example, it may be desirable to engineer the electromagnetic properties of sheet 100 so that it functions as a specular ground plane for radar or for radio frequency communications, thereby facilitating use of portable phones, cell phones, radios, microwave transmission, or other wireless telecommunications. Any suitable arrangement of sheet 100 and fluid channels 106 for yielding desirable electromagnetic properties may be designed and implemented, and shall fall within the scope of the present disclosure or appended claims.

For purposes of the present disclosure and appended claims, the conjunction "or" is to be construed inclusively (e.g., "a dog or a cat" would be interpreted as "a dog, or a cat, or both"), unless: i) it is explicitly stated otherwise, or ii) two or more of the listed alternatives are mutually exclusive within the particular context, in which case "or" would encompass only those combinations involving non-mutually-exclusive alternatives. It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

What is claimed is:

1. A passive fire suppression surface system, comprising:

a substantially flat sheet having a plurality of open fluid channels therethrough, each fluid channel having an upper opening at an upper surface of the sheet and a corresponding lower opening at a lower surface of the sheet, thereby enabling fluid spilled on the upper surface of the sheet to flow therethrough by flowing through at least one of the fluid channels; and a plurality of support members, wherein:

the support members lie on a support surface in a spaced-apart arrangement;

the sheet rests on the support members and is thereby positioned substantially parallel to and offset vertically above the support surface, the support surface and the sheet thereby defining a containment space for receiving fluid spilled on the upper surface of the sheet that flows through the fluid channels of the sheet; and the area of each upper opening is larger than about twice the area of each corresponding lower opening so as to restrict flow of air into the containment space or restrict escape of combustion products from the containment space, thereby suppressing combustion of a flammable fluid spilled on the upper surface of the sheet.

2. The apparatus of claim 1, wherein the sheet comprises metallic material, ceramic material, or polymer material.

3. The apparatus of claim 2, wherein the sheet comprises metallic material, and the plurality of fluid channels are arranged so that the sheet may serve as an electromagnetic specular ground plane over a desired operating frequency range.

4. The apparatus of claim 1, wherein the area of each channel decreases substantially monotonically from the upper opening to the lower opening.

5. The apparatus of claim 1, wherein the fluid channels are frusto-conical in shape.

6. The apparatus of claim 5, wherein heat radiated from below the sheet is preferentially redirected by the sheet in a direction substantially perpendicular to the sheet.

7. The apparatus of claim 1, wherein the area of each lower opening is less than about 10 $mm^2$, the sheet is between about 3 mm thick and about 10 mm thick, and the fluid channels are arranged in a two-dimensional lattice pattern with a spacing between about 3 mm and about 10 mm.

8. The apparatus of claim 1, wherein the spacing of the fluid channels and the area of the upper openings thereof result in an upper sheet surface comprising a plurality of ridges extending along the sheet in at least two directions thereby forming a grid.

9. The apparatus of claim 8, wherein the upper area of the plurality of ridges is sufficiently small so as to substantially eliminate fluid accumulation on the upper surface of the sheet.

10. The apparatus of claim 8, wherein the plurality of ridges comprising the upper sheet surface provide a non-slip or non-skid surface.

11. The apparatus of claim 1, wherein the support members comprise a plurality of elongated support members lying on the support surface in a spaced-apart, side-by-side arrangement.

12. The apparatus of claim 11, wherein the support members are secured to or formed on the lower surface of the sheet.

13. The apparatus of claim 11, wherein the support members and the sheet comprise mechanically separate components.

14. The apparatus of claim 13, wherein the support members are secured to or formed on the support surface.

15. The apparatus of claim 11, wherein the support members support the sheet at a height above the support surface between about 3 mm and about 10 mm.

16. The apparatus of claim 11, further comprising baffle members positioned between the support members so as to impede flow of air or spilled fluid within the containment space.

17. The apparatus of claim 16, wherein elongated baffle members are oriented approximately transversely to the support members, so as to impede flow of air or spilled fluid parallel to the support members within the containment space.

18. The apparatus of claim 16, wherein the baffle members are secured to or formed on the lower surface of the sheet.

19. The apparatus of claim 16, wherein the baffle members and the sheet comprise mechanically separate components.

20. The apparatus of claim 19, wherein the baffle members are secured to or formed on the support surface.

21. The apparatus of claim 1, further comprising fire retardant material applied to the lower surface of the sheet.

22. The apparatus of claim 21, wherein the lower surface of the sheet includes recessed regions between the fluid channels, and the recessed regions contain fire retardant material.

23. The apparatus of claim 21, wherein the fire retardant material comprises a binary agent, a decomposing agent, or a de-volatilizing agent.

24. The apparatus of claim 1, wherein the lower surface of the sheet includes recessed regions between the fluid channels, thereby enhancing convective cooling of the sheet.

25. The apparatus of claim 1, further comprising a second similarly adapted sheet resting on a second plurality of support members on the upper surface of the sheet.

26. A method for passively suppressing combustion of flammable fluid spilled on a support surface, comprising covering at least a portion of the support surface with a substantially flat sheet supported by a plurality of support members, wherein:

the sheet is provided with a plurality of open fluid channels therethrough, each fluid channel having an upper opening at an upper surface of the sheet and a corresponding lower opening at a lower surface of the sheet, thereby enabling fluid spilled on the upper surface of the sheet to flow therethrough by flowing through at least one of the fluid channels;

the support members lie on a support surface in a spaced-apart arrangement;

the sheet rests on the support members and is thereby positioned substantially parallel to and offset vertically above the support surface, the support surface and the sheet thereby defining a containment space for receiving fluid spilled on the upper surface of the sheet that flows through the fluid channels of the sheet; and the area of each upper opening is larger than about twice the area of each corresponding lower opening so as to i) restrict flow of air into the containment space, or ii) restrict escape of combustion products from the containment space, thereby suppressing combustion of a flammable fluid spilled on the upper surface of the sheet.

27. The method of claim 26, wherein the support surface comprises at least a portion of: an aircraft carrier flight deck or hangar deck; a helipad; the floor of an engine compartment; the ground near a refueling facility; the floor of a vehicle repair facility; the floor of a fuel, solvent, or chemical storage area; the floor of a fuel, solvent, or chemical processing facility; the ground near a fuel, solvent, or chemical loading or unloading zone or shipping terminal; the floor of a semiconductor processing facility; the ground of a racetrack pit area; an oil drilling platform; an aircraft hangar; or the floor of a mill or manufacturing facility.

28. The method of claim 26, wherein the sheet comprises metallic material, ceramic material, or polymer material.

29. The method of claim 28, wherein the sheet comprises metallic material, and the plurality of fluid channels are arranged so that the sheet may serve as an electromagnetic specular ground plane over a desired operating frequency range.

30. The method of claim 26, wherein the area of each channel decreases substantially monotonically from the upper opening to the lower opening.

31. The method of claim 26, wherein the fluid channels are frusto-conical in shape.

32. The method of claim 31, wherein heat radiated from below the sheet is preferentially redirected by the sheet in a direction substantially perpendicular to the sheet.

33. The method of claim 26, wherein the area of each lower opening is less than about 10 $mm^2$, the sheet is between about 3 mm thick and about 10 mm thick, and the fluid channels are arranged in a two-dimensional lattice pattern with a spacing between about 3 mm and about 10 mm.

34. The method of claim 26, wherein the spacing of the fluid channels and the area of the upper openings thereof result in an upper sheet surface comprising a plurality of ridges extending along the sheet in at least two directions thereby forming a grid.

35. The method of claim 34, wherein the upper area of the plurality of ridges is sufficiently small so as to substantially eliminate fluid accumulation on the upper surface of the sheet.

36. The method of claim 34, wherein the plurality of ridges comprising the upper sheet surface provide a non-slip or non-skid surface.

37. The method of claim 26, wherein the support members comprise a plurality of elongated support members lying on the support surface in a spaced-apart, side-by-side arrangement.

38. The method of claim 37, wherein the support members are secured to or formed on the lower surface of the sheet.

39. The method of claim 37, wherein the support members and the sheet comprise mechanically separate components.

40. The method of claim 39, wherein the support members are secured to or formed on the support surface.

41. The method of claim 37, wherein the support members support the sheet at a height above the support surface between about 3 mm and about 10 mm.

42. The method of claim 37, wherein the sheet further comprises baffle members positioned between the support members so as to impede flow of air or spilled fluid within the containment space.

43. The method of claim 42, wherein elongated baffle members are oriented approximately transversely to the support members, so as to impede flow of air or spilled fluid parallel to the support members within the containment space.

44. The method of claim 42, wherein the baffle members are secured to or formed on the lower surface of the sheet.

45. The method of claim 42, wherein the baffle members and the sheet comprise mechanically separate components.

46. The method of claim 45, wherein the baffle members are secured to or formed on the support surface.

47. The method of claim 26, wherein the sheet further comprises fire retardant material applied to the lower surface of the sheet.

48. The method of claim 47, wherein the lower surface of the sheet includes recessed regions between the fluid channels, and the recessed regions contain fire retardant material.

49. The method of claim 47, wherein the fire retardant material comprises a binary agent, a decomposing agent, or a de-volatilizing agent.

50. The method of claim 26, wherein the lower surface of the sheet includes recessed regions between the fluid channels, thereby enhancing convective cooling of the sheet.

51. The method of claim 26, further comprising covering at least a portion of the sheet with a second similarly adapted sheet resting on a second plurality of support members.

52. A method for forming a passive fire suppression surface system, comprising:

forming a substantially flat sheet having a plurality of open fluid channels therethrough, each fluid channel having an upper opening at an upper surface of the sheet and a corresponding lower opening at a lower surface of the sheet, thereby enabling fluid spilled on the upper surface of the sheet to flow therethrough by flowing through at least one of the fluid channels; and forming a plurality of support members adapted for lying on a support surface in a spaced-apart arrangement and for supporting the sheet, thereby positioning the sheet substantially parallel to and offset vertically above the support surface, the support surface and the sheet thereby defining a containment space for receiving fluid spilled on the upper surface of the sheet that flows through the fluid channels of the sheet, wherein the area of each upper opening is larger than about twice the area of each corresponding lower opening so as to restrict flow of air into the containment space or restrict escape of combustion products from the containment space, thereby suppressing combustion of a flammable fluid spilled on the upper surface of the sheet when the sheet rests on the support members on the support surface.

53. The method of claim 52, wherein the sheet is formed by molding, casting, stamping, extrusion, or milling.

54. The method of claim 52, wherein the sheet comprises metallic material, ceramic material, or polymer material.

55. The method of claim 54, wherein the sheet comprises metallic material, and the plurality of fluid channels are arranged so that the sheet may serve as an electromagnetic specular ground plane over a desired operating frequency range.

56. The method of claim 52, wherein the area of each channel decreases substantially monotonically from the upper opening to the lower opening.

57. The method of claim 52, wherein the fluid channels are frusto-conical in shape.

58. The method of claim 57, wherein heat radiated from below the sheet is preferentially redirected by the sheet in a direction substantially perpendicular to the sheet.

59. The method of claim 52, wherein the area of each lower opening is less than about 10 $mm^2$, the sheet is between about 3 mm thick and about 10 mm thick, and the fluid channels are arranged in a two-dimensional lattice pattern with a spacing between about 3 mm and about 10 mm.

60. The method of claim 52, wherein the spacing of the fluid channels and the area of the upper openings thereof result in an upper sheet surface comprising a plurality of ridges extending along the sheet in at least two directions thereby forming a grid.

61. The method of claim 60, wherein the upper area of the plurality of ridges is sufficiently small so as to substantially eliminate fluid accumulation on the upper surface of the sheet.

62. The method of claim 60, wherein the plurality of ridges comprising the upper sheet surface provide a non-slip or non-skid surface.

63. The method of claim 52, wherein the support members comprise a plurality of elongated support members lying on the support surface in a spaced-apart, side-by-side arrangement.

64. The method of claim 63, further comprising securing the support members to the lower surface of the sheet or forming the support members on the lower surface of the sheet.

65. The method of claim 63, wherein the support members and the sheet comprise mechanically separate components.

66. The method of claim 65, further comprising securing the support members to the support surface or forming the support members on the support surface.

67. The method of claim 63, wherein the support members support the sheet at a height above the support surface between about 3 mm and about 10 mm.

68. The method of claim 63, further comprising forming baffle members for being positioned between the support members so as to impede flow of air or spilled fluid within the containment space.

69. The method of claim 68, wherein elongated baffle members are for being oriented approximately transversely to the support members, so as to impede flow of air or spilled fluid parallel to the support members within the containment space.

70. The method of claim 68, further comprising securing the baffle members to the lower surface of the sheet or forming the baffle members on the lower surface of the sheet.

71. The method of claim 68, wherein the baffle members and the sheet comprise mechanically separate components.

72. The method of claim 71, further comprising securing the baffle members to the support surface or forming the baffle members on the support surface.

73. The method of claim 52, further comprising applying fire retardant material to the lower surface of the sheet.

74. The method of claim 73, further comprising forming recessed regions on the lower surface of the sheet, and applying fire retardant material within the recessed regions.

75. The method of claim 73, wherein the fire retardant material comprises a binary agent, a decomposing agent, or a de-volatilizing agent.

76. The method of claim 52, further comprising forming recessed regions on the lower surface of the sheet, thereby enhancing convective cooling of the sheet.

77. The method of claim 52, further comprising:

forming a second similarly adapted sheet; and forming a second plurality of support members for adapted for lying on the upper surface of the sheet and for supporting the second sheet.

* * * * *